US005344552A

United States Patent [19]

Marolleau et al.

[11] Patent Number: 5,344,552

[45] Date of Patent: Sep. 6, 1994

[54] PROCESS FOR ELECTROPLATING A METAL STRIP

[75] Inventors: Isabelle Marolleau, Basse-Ham; Jean-Denis Girardier, Metz, both of France

[73] Assignee: Sollac, Puteaux, France

[21] Appl. No.: 947,730

[22] Filed: Sep. 21, 1992

[30] Foreign Application Priority Data

Oct. 16, 1991 [FR] France ..... 91 12770

[51] Int. Cl.[5] ..... C25D 7/06

[52] U.S. Cl. ..... 205/138; 205/141; 205/155; 205/177

[58] Field of Search ..... 205/129, 130, 138, 141, 205/155, 117, 305

[56] References Cited

FOREIGN PATENT DOCUMENTS 2460347 1/1981 France .
72095 3/1991 Japan .

OTHER PUBLICATIONS

Patent Abstracts of Japan, vol. 10, No. 377 (C-392)(2434), Dec. 1986 & JP-A-61 170 595, (Nippon Steel Corp) Aug. 1, 1986, "Manufacture of Galvanized Steel Sheet."

*Primary Examiner*—John Niebling
*Assistant Examiner*—Kishor Mayekar
*Attorney, Agent, or Firm*—Oblon, Spivak, McClelland, Maier & Neustadt

[57] ABSTRACT

According to this process, the strip runs through a bath of at least one electrolytic cell and two metal layers are successively deposited onto its surface by adjusting the current feeding the electrolytic cell so that the average value of the current density at the surface of the strip is less than a value called the limiting diffusion current of the ions of the metal to be deposited. In addition, during the formation of the first metal layer, the current is adjusted so as to prevent the appearance of localized overcurrents at the surface of the strip, it being possible for these overcurrents to exceed the limiting diffusion current. Such a process find particular application for electrogalvanizing.

Application to an electrogalvanising process.

12 Claims, No Drawings

PROCESS FOR ELECTROPLATING A METAL STRIP

BACKGROUND OF THE INVENTION

1. Field of the Invention

The present invention relates to an improved process for electroplating a metal strip. It is particularly applicable to the formation of a zinc coating or deposit on a strip.

2. Discussion of the Background

It is known how to form a zinc coating on a strip by making the latter run through a bath of at least one electrolytic cell, in which the strip constitutes the cathode. This cell is fed with an adjustable current. The conditions for forming the zinc deposit depend in particular on the current density at the surface of the strip. There is a limiting value of the current density, called the "limiting diffusion current of the zinc ions", for which the deposit crystallises in a dendritic form whose macroscopic appearance is called "burnt deposit" by the person skilled in the art. Furthermore, at such values of current density, there occurs a release of hydrogen, part of which may be adsorbed by the strip. This release of hydrogen may lead to a formation of zinc hydroxide, $Zn(OH)_2$, by local modification of the pH, which is fixed between the strip and the zinc deposit. The operations performed subsequently on the strip, such as painting, can then lead to a degradation of the strip.

The current feeding the electrolytic cell is normally adjusted so as to obtain, at the surface of the strip, a current density less than the aforementioned limiting value. Prior to the electroplating operation, operations for preparing the strip are performed, especially comprising a degreasing operation. However, despite these preparation operations, impurities sometimes remain at the surface of the strip causing the deviation of the current lines and the appearance of overcurrent zones around these impurities. In these zones, the current density can reach, or indeed exceed, the limiting diffusion current, thereby causing the phenomenon mentioned hereinabove of adsorption of hydrogen at and of fixing of zinc hydroxide to the surface of the strip.

In this case, in addition to the reduction in quality of the adherence of the zinc coating, a microscopic loss of cohesion of the coating is observed when the strip subsequently undergoes a stoving treatment intended, for example, to polymerise a paint layer covering the coated strip. Hydrogen, which has been adsorbed at the surface of the strip during the electroplating operation, is released during the stoving, thereby forming craters and pimples at the surface of the coating of the strip.

SUMMARY OF THE INVENTION

The object of the invention is especially to form an electrolytic metal deposit at the surface of a flat product or strip whose adherence and cohesion are of good quality and do not degrade, for example, during a stoving treatment.

For this purpose, the subject of the invention is a process for electroplating a metal strip, of the type in which the strip is run through a bath of at least one electrolytic cell containing a solution of ions of a metal to be deposited onto the strip and comprising electrically conducting rollers, forming a cathode, in contact with the strip and at least one anode placed in the vicinity of each roller, each conducting-roller/anode pair being fed with an adjustable electrical current I whose density J at the surface of the metal sheet can reach or exceed a value called the limiting diffusion current Jl of the ions, characterised in that the deposition is carried out in two phases, by adjusting the current I of a first and of a second series of conducting-roller/anode pairs so that, on the one hand, during the two phases, the average value Jm of the current density at the surface of the strip is less than the limiting diffusion current Jl and that, on the other hand, during the first phase, the local value of the current density J, at any point on the surface of the strip, is less than the limiting diffusion current Jl.

According to other characteristics of the invention:

the second metal-deposition phase is carried out by adjusting the current I of the second series of conducting-roller/anode pairs so as to obtain an average value Jm of the current density greater than the average value of the current density used for forming the first deposit;

during the first metal-deposition phase, the current I of the first series of conducting-roller/anode pairs is adjusted so that the average value Jm of the current density at the surface of the strip satisfies the following relationship:

$$10\%\ Jl \leqq Jm \leqq 40\%\ Jl;$$

the metal layer deposited during the first deposition phase has a thickness of between 4 and 5 μm, preferably 5 μm;

during the second metal-deposition phase, the current I of the second series of conducting-roller/anode pairs is adjusted so that the average value Jm of the current density at the surface of the strip satisfies the following relationship:

$$50\%\ Jl \leqq Jm \leqq 90\%\ Jl;$$

the run speed V of the strip is substantially the same during the two metal-deposition phases;

the metal deposited onto the strip is zinc.

According to a first embodiment of the process, the first metal-deposition phase corresponds to the passage of the strip in a first conducting-roller/anode pair of a first electrolytic cell.

According to a second embodiment of the process, the first metal-deposition phase corresponds to the passage of the strip in the two first conducting-roller/anode pairs of a first electrolytic cell.

DESCRIPTION OF THE PREFERRED EMBODIMENTS

One example for implementing the process according to the invention is described in more detail hereinbelow.

In this example, the electroplating process according to the invention is applied to the formation of a zinc coating, of a thickness of approximately 20 μm, on a metal strip. This particular application of the process is commonly called electrogalvanising. The zinc coating is formed in two stages. A 5 μm thick zinc layer is deposited during the first stage and a 15 μm thick zinc layer is deposited during the second stage.

The strip runs at a speed V between 40 and 180 m/min in a bath of at least one electrolytic cell containing zinc ions to be deposited onto the strip.

The electrolytic cell conventionally comprises electrically conducting rollers, forming a cathode, in contact with the metal strip, and at least one anode placed in the vicinity of each roller. Each conducting-roller/anode pair is fed with an electrical current of suitable intensity I.

The coating metal contained in the bath is transported in the electrolyte by the electrolysis current between the anodes and the strip raised to a cathodic potential by the electrically conducting rollers.

The electrolysis current has a density J, at the surface of the strip, which can reach, or indeed exceed, the limiting diffusion current Jl of the zinc ions to be deposited. This limiting value Jl depends on the characteristics of the bath and on the run speed V of the strip or, more precisely, on the renewal of electrolyte in the space between the cathode and the anode, as well as on the temperature of the bath. Under the conditions of the example, $Jl=150A/dm^2$.

For all the stages of the process, the current feeding the electrolytic cell is adjusted so that the average value Jm of the current density at the surface of the strip is less than the limiting current Jl.

During the first stage of the process, the current of a first series of conducting-roller/anode pairs is adjusted so that the current density J at the surface of the strip is, at any point on the latter, less than the limiting current Jl so as to prevent the appearance, at the surface of the strip, of overcurrents of a value greater than the limiting current Jl. This condition, as well as the preceding one, are especially fulfilled when the average value Jm of the current density satisfies the relationship:

$$10\%\ Jl \leqq Jm \leqq 40\%\ Jl.$$

In the example described, the current is adjusted so that $Jm=15A/dm^2=10\%$ Jl and a first zinc deposition of 5 μm thickness is carried out. Under these conditions, even if impurities remain at this surface of the strip, the current density J does not exceed the limiting diffusion value Jl. Consequently, there is no adsorption of hydrogen at nor fixing of zinc hydroxide $Zn(OH)_2$ to the surface of the strip.

The first zinc-deposition stage may be carried out by, for example, passing the strip in a first conducting-roller/anode pair fed with a current adjusted according to the conditions which have just been described, or alternatively by passing the strip in the two first conducting-roller/anode pairs fed with a current adjusted according to these same conditions.

During the second stage of the process, a second zinc deposition is carried out on the first deposition in order to complete the zinc coating to the desired thickness of 20 μm. This second deposit is formed by adjusting the current of a second series of conducting-roller/anode pairs, so that its average density Jm at the surface of the strip is higher than that at the first stage and less than the limiting current Jl. These conditions are especially fulfilled when the average value Jm of the current density satisfies the relationship:

$$50\%\ Jl \leqq Jm \leqq 90\%\ Jl.$$

In the example described, this current is adjusted so that $Jm=110A/dm^2=73\%$ Jl.

The absence of the formation of hydrogen and of zinc hydroxide $Zn(OH)_2$ during the electroplating process according to the invention consequently enables loss of adhesion of the zinc coating to be avoided during a stoving operation intended, for example, to polymerise a paint layer on the strip.

Of course the two successive stages of the process can also be performed in two electrolytic cells arranged in series and the two stages of the process can be linked together in a continuous or discontinuous fashion.

We claim:

1. A process for electroplating a metal strip in a bath of at least one electrolyte cell comprising a solution of ions of a metal to be deposited onto the metal strip, comprising the steps of:

running the metal strip by a first conducting roller-/anode pair in the bath comprising at least one electrically conducting roller, forming a cathode, in contact with the metal strip and at least one anode in a vicinity of each said conducting roller, the first conducting roller/anode pair being fed with a first adjustable current having a first current density at a surface of the metal strip which can exceed a limiting diffusion current Jl of the ions, wherein the first adjustable current of the first conducting roller/anode pair is adjusted so that a first average value $Jm_1$ of the first current density at the surface of the metal strip satisfies the relationship:

$$10\%\ Jl \leqq Jm_1 \leqq 40\%\ Jl$$

and running the metal strip by a second conducting roller/anode pair in the bath comprising at least one electrically conducting roller, forming a cathode, in contact with the metal strip and at least one anode in a vicinity of each said conducting roller, the second conducting roller/anode pair being fed with a second adjustable current having a second current density at a surface of the metal strip which can exceed the limiting diffusion current Jl of the ions, wherein the second adjustable current of the second conducting roller/anode pair is adjusted so that a second average value $Jm_2$ of the second current density at the surface of the metal strip satisfies the relationship:

$$50\%\ Jl \leqq Jm_2 \leqq 90\%\ Jl.$$

2. The process according to claim 1, wherein a metal layer deposited during the running of the metal strip by the first conducting roller/anode pair has a thickness of between and 4 and 6 μm.

3. The process according to claim 1, wherein the first and second conducting roller/anode pairs are formed in a same electrolytic cell.

4. The process according to claim 1, wherein a run speed V of the metal strip is substantially the same as the metal strip is run by the fist conducting roller/anode pair and the second conducting roller/anode pair.

5. The process according to claim 1, wherein the metal deposited onto the metal strip is zinc.

6. A process for electroplating a metal strip, wherein the strip is run through a bath of at least one electrolytic cell containing a solution of ions of a metal to be deposited onto the strip and comprising two series of conducting-roller/anode pairs, each said conducting-roller-/anode pair comprising an electrically conducting roller, forming a cathode, in contact with said strip and at least one anode placed in a vicinity of each said roller, each said conducting-roller/anode pair being fed with an adjustable electrical current I whose density J at a surface of the metal strip can reach or exceed a limiting diffusion current Jl of the ions, wherein the deposition is carried out in two phases, by adjusting the current I of a first and a second series of said conducting-roller-/anode pairs, and wherein, during the first metal-deposition phase, the current I of the first series of said conducting-roller anode pairs is adjusted so that a first average value $Jm_1$ of a first current density at the surface of the strip satisfies the following relationship:

$$10\%\ Jl \leqq Jm_1 \leqq 40\%\ Jl$$

and, during the second metal-deposition phase, the current I of the second series of said conducting-roller-/anode pairs is adjusted so that a second average value $Jm_2$ of a second current density at the surface of the strip satisfies the following relationship:

$$50\%\ Jl \leqq Jm_2 \leqq 90\%\ Jl.$$

7. The process according to claim 6, wherein a metal layer deposited during the first deposition phase has a thickness of between 4 and 6 μm.

8. The process according to claim 6, wherein the first metal-deposition phase corresponds to a passage of the strip in a first conducting-roller/anode pair of a first electrolytic cell.

9. The process according to claim 6, wherein the first metal-deposition phase corresponds to a passage of the strip in two first conducting-roller/anode pairs of a first electrolytic cell.

10. The process according to claim 6, wherein a run speed V of the metal strip is substantially the same during the two metal-deposition phases.

11. The process according to claim 6, wherein the metal deposited onto the metal strip is zinc.

12. Process according to claim 6, wherein a metal layer deposited during the first deposition phase has a thickness of 5 μm.

* * * * *